US008818539B2

(12) United States Patent
Suzuki et al.

(10) Patent No.: US 8,818,539 B2
(45) Date of Patent: Aug. 26, 2014

(54) AUDIO ENCODING DEVICE, AUDIO ENCODING METHOD, AND VIDEO TRANSMISSION DEVICE

(75) Inventors: Masanao Suzuki, Kawasaki (JP); Miyuki Shirakawa, Fukuoka (JP); Yoshiteru Tsuchinaga, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 796 days.

(21) Appl. No.: 12/829,650

(22) Filed: Jul. 2, 2010

(65) Prior Publication Data

US 2011/0002393 A1 Jan. 6, 2011

(30) Foreign Application Priority Data

Jul. 3, 2009 (JP) ..... 2009-158991

(51) Int. Cl.

| | |
|---|---|
| ***G10L 19/00*** | (2013.01) |
| ***G10L 19/008*** | (2013.01) |
| ***G10L 19/02*** | (2013.01) |
| *H04R 5/00* | (2006.01) |

(52) U.S. Cl.

CPC ..... *G10L 19/008* (2013.01); *G10L 19/0204* (2013.01)

USPC ..... 700/94; 704/500; 704/501; 381/22; 381/17; 381/23

(58) Field of Classification Search

CPC ... G10L 19/008; G10L 19/0204; G10L 19/24; G10L 21/038; H04S 2420/03; H04S 3/008; H04S 1/007; H04S 3/02

USPC ..... 700/94; 704/500, 501; 381/23, 22, 17

See application file for complete search history.

(56) References Cited

U.S. PATENT DOCUMENTS

| | | | | |
|---|---|---|---|---|
| 2007/0127585 | A1 * | 6/2007 | Suzuki et al. | 375/265 |
| 2008/0097751 | A1 * | 4/2008 | Tsuchinaga et al. | 704/205 |
| 2008/0219344 | A1 | 9/2008 | Suzuki et al. | |
| 2008/0260048 | A1 | 10/2008 | Oomen et al. | |
| 2009/0222272 | A1 * | 9/2009 | Seefeldt et al. | 704/500 |

FOREIGN PATENT DOCUMENTS

| | | | |
|---|---|---|---|
| JP | 2007-183528 | | 7/2007 |
| JP | 2007-524124 | | 8/2007 |
| JP | 2008-224902 | | 9/2008 |
| WO | WO 2007/040353 | * | 4/2007 |

* cited by examiner

*Primary Examiner* — Curtis Kuntz
*Assistant Examiner* — Thomas Maung
(74) *Attorney, Agent, or Firm* — Staas & Halsey LLP

(57) ABSTRACT

An audio encoding device includes, a time-frequency transform unit that transforms signals of channels included in an audio signal having a first number of channels into frequency signals respectively, a down-mix unit that generates an audio frequency signal having a second number of channels, a low channel encoding unit that generates a low channel audio code by encoding the audio frequency signal, a space information extraction unit that extracts space information representing spatial information of a sound, an importance calculation unit that calculates importance on the basis of the space information, a space information correction unit that corrects the space information, a space information encoding unit that generates a space information code, and a multiplexing unit that generates an encoded audio signal by multiplexing the low channel audio code and the space information code.

10 Claims, 12 Drawing Sheets

FIG. 3

| INDEX | 0 | 1 | 2 | 3 | 4 | 5 | 6 | 7 |
|---|---|---|---|---|---|---|---|---|
| SIMILARITY | 1 | 0.937 | 0.84118 | 0.60092 | 0.36764 | 0 | -0.589 | -1 |

310 320 300

FIG. 4

| DIFFERENCE BETWEEN INDEXES | SIMILARITY CODE |
|---|---|
| -7 | 11111111111111 |
| -6 | 11111111111110 |
| -5 | 111111111110 |
| -4 | 1111111110 |
| -3 | 1111110 |
| -2 | 11110 |
| -1 | 110 |
| 0 | 0 |

| DIFFERENCE BETWEEN INDEXES | SIMILARITY CODE |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

400

FIG. 5

| | | | | | | | | | |
|---|---|---|---|---|---|---|---|---|---|
| INDEX | -7 | -6 | -5 | -4 | -3 | -2 | -1 | 0 | 510 |
| INTENSITY DIFFERENCE | -25 | -18 | -14 | -10 | -7 | -4 | -2 | 0 | 520 |
| INDEX | 1 | 2 | 3 | 4 | 5 | 6 | 7 | | 530 |
| INTENSITY DIFFERENCE | 2 | 4 | 7 | 10 | 14 | 18 | 25 | | 540 |

500

AUDIO ENCODING DEVICE, AUDIO ENCODING METHOD, AND VIDEO TRANSMISSION DEVICE

CROSS-REFERENCE TO RELATED APPLICATIONS

This application is based upon and claims the benefit of priority of the prior Japanese Patent Application No. 2009-158991, filed on Jul. 3, 2009, the entire contents of which are incorporated herein by reference.

FIELD

Various embodiments described herein relate to an audio encoding device, an audio encoding method, and a video transmission device.

BACKGROUND

In recent years, as an audio signal encoding method having high compression efficiency, parametric stereo coding method has been developed (for example, refer to Japanese National Publication of International Patent Application No. 2007-524124). For example, the parametric stereo coding method extracts space information which represents a spread or localization of sound and encodes the extracted space information. The parametric stereo coding method is employed in, for example, High-Efficiency Advanced Audio Coding version.2 (HE-AAC ver.2) of Moving Picture Experts Group phase 4 (MPEG-4).

In the HE-AAC ver.2, a stereo signal to be encoded is time-frequency transformed, and a frequency signal obtained by the time-frequency transform is down mixed, so that a frequency signal corresponding to monaural sound is calculated. The frequency signal corresponding to monaural sound is encoded by an Advanced Audio Coding (AAC) method and a Spectral Band Replication (SBR) coding method. On the other hand, similarity or intensity difference between left and right frequency signals is calculated as space information, and the similarity and the intensity difference are respectively quantized to be encoded. In this way, in the HE-AAC ver.2, the monaural signal calculated from a stereo signal and the space information having a relatively small data amount are encoded, and thus high compression efficiency of a stereo signal can be obtained.

SUMMARY

According to an embodiment, an audio encoding device includes a time-frequency transform unit that transforms signals of channels included in an audio signal having a first number of channels into frequency signals respectively by time-frequency transforming the signals of the channels frame by frame, the frame having a predetermined time length; a down-mix unit that generates an audio frequency signal having a second number of channels which is smaller than the first number of channels by down-mixing the frequency signals of the channels; a low channel encoding unit that generates a low channel audio code by encoding the audio frequency signal; a space information extraction unit that extracts space information representing spatial information of a sound from the frequency signals of the channels; an importance calculation unit that calculates importance representing a degree how much the space information affects human hearing for each frequency on the basis of the space information; a space information correction unit that corrects the space information so that the space information at a frequency having importance smaller than a predetermined threshold value is smoothed in a frequency direction; a space information encoding unit that generates a space information code by encoding a difference of space information obtained by calculating a difference of values of the corrected space information in the frequency direction; and a multiplexing unit that generates an encoded audio signal by multiplexing the low channel audio code and the space information code.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 3 is a diagram showing an example of a quantization table of similarities;

FIG. 4 is a diagram showing an example of a table showing a relationship between a relationship between differences between indexes and similarity codes;

FIG. 5 is a diagram showing an example of a quantization table for intensity difference;

DESCRIPTION OF EMBODIMENTS

Hereinafter, an audio encoding device according to an embodiment will be described with reference to the drawings.

The audio encoding device encodes a stereo signal in accordance with the parametric stereo coding method. When encoding the stereo signal, the audio encoding device reduces a data amount of an encoded stereo signal by smoothing space information in a frequency band not important for human hearing in the frequency direction.

Figure 1:
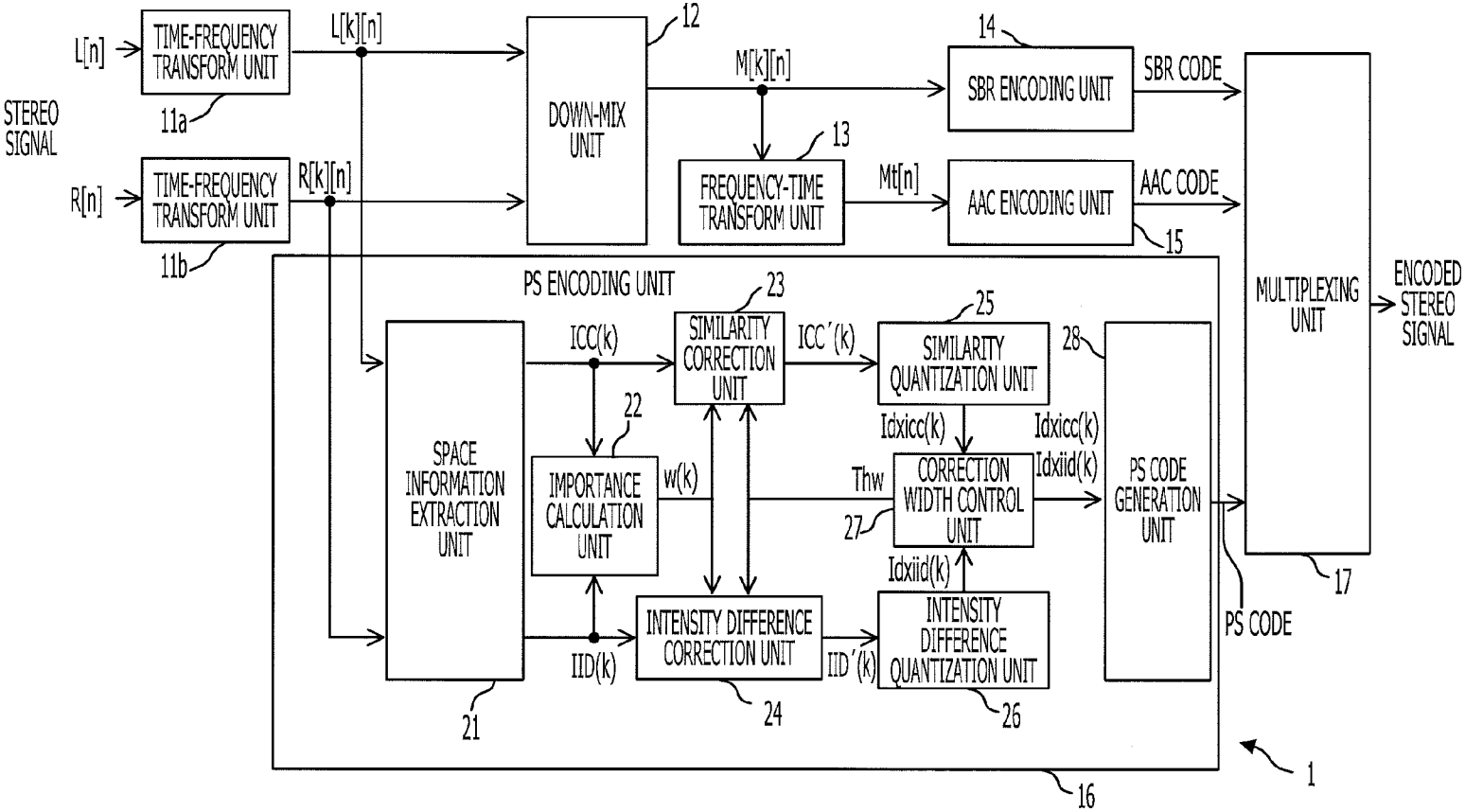
FIG. 1 is a schematic configuration diagram of an audio encoding device according to an embodiment.

FIG. 1 is a schematic configuration diagram of an audio encoding device 1 according to an embodiment. As shown in FIG. 1, the audio encoding device 1 includes time-frequency transform units 11*a* and 11*b*, a down-mix unit 12, a frequency-time transform unit 13, an SBR encoding unit 14, an AAC encoding unit 15, a PS encoding unit 16, and a multiplexing unit 17.

Each unit included in the audio encoding device 1 is formed as a separate circuit. Or, each unit included in the audio encoding device 1 may be mounted in the audio encoding device 1 as an integrated circuit in which circuits corresponding to the units are integrated. Further, at least a part of the units included in the audio encoding device 1 may be realized by a computer program executed on a processor included in the audio encoding device 1. Examples of computer-readable recording media for storing the computer program include recording media storing information optically, electrically, or magnetically such as CD-ROM, flexible disk, magneto-optical disk, hard disk, and the like, and semiconductor memories storing information electrically such as ROM, flash memory, and the like. However, transitory media such as a propagating signal are not included in the recording media described above.

The time-frequency transform unit 11*a* transforms a left stereo signal of a time domain stereo signal inputted into the audio encoding device 1 into a left frequency signal by time-frequency transforming the left stereo signal frame by frame. On the other hand, the time-frequency transform unit 11*b* transforms a right stereo signal into a right frequency signal by time-frequency transforming the right stereo signal frame by frame.

In this embodiment, the time-frequency transform unit 11*a* transforms a left stereo signal L[n] into a left frequency signal L[k][n] by using a Quadrature Mirror Filter (QMF) filter bank given in the equation described below. In the same way, the time-frequency transform unit 11*b* transforms a right stereo signal R[n] into a right frequency signal R[k][n] by using the QMF filter bank.

$$QMF[k][n] = \exp\left[j\frac{\pi}{128}(k+0.5)(2n+1)\right], \quad 0 \le k < 64,\ 0 \le n < 128 \tag{1}$$

Here, n is a variable representing time, and represents nth time when equally dividing one frame of the stereo signal by 128 in the time direction. The frame length may be any time from 10 to 80 msec. k is a variable representing a frequency band, and represents kth frequency band when equally dividing a frequency band of a frequency signal by 64. QMF[k][n] is a QMF for outputting a frequency signal of time n and frequency k.

The time-frequency transform units 11*a* and 11*b* may transform a left stereo signal and a right stereo signal respectively into a left frequency signal and a right frequency signal by using another time-frequency transform processing such as fast Fourier transform, discrete cosine transform, and modified discrete cosine transform.

Every time the time-frequency transform unit 11*a* calculates the left frequency signal frame by frame, the time-frequency transform unit 11*a* outputs the left frequency signal to the down-mix unit 12 and the PS encoding unit 16. In the same way, every time the time-frequency transform unit 11*b* calculates the right frequency signal frame by frame, the time-frequency transform unit 11*b* outputs the right frequency signal to the down-mix unit 12 and the PS encoding unit 16.

Every time the down-mix unit 12 receives the left frequency signal and the right frequency signal, the down-mix unit 12 generates a monaural frequency signal by down-mixing the left frequency signal and the right frequency signal. For example, the down-mix unit 12 calculates a monaural frequency signal M[k][n] in accordance with the following equations.

$$M_{Re}[k][n]=(L_{Re}[k][n]+R_{Re}[k][n])/2 \quad 0\le k<64,\ 0\le n<128$$

$$M_{Im}[k][n]=(L_{Im}[k][n]+R_{Im}[k][n])/2$$

$$M[k][n]=M_{Re}[k][n]+j\cdot M_{Im}[k][n] \tag{2}$$

Here, $L_{Re}$[k][n] represents the real part of the left frequency signal, and $L_{Im}$[k][n] represents the imaginary part of the left frequency signal. $R_{Re}$[k][n] represents the real part of the right frequency signal, and $R_{Im}$[k][n] represents the imaginary part of the right frequency signal.

Every time the down-mix unit 12 generates the monaural frequency signal, the down-mix unit 12 outputs the monaural frequency signal to the frequency-time transform unit 13 and the SBR encoding unit 14.

Every time the frequency-time transform unit 13 receives the monaural frequency signal, the frequency-time transform unit 13 transforms the monaural frequency signal into a time domain monaural signal. For example, when the time-frequency transform units 11*a* and 11*b* use the QMF filter bank, the frequency-time transform unit 13 frequency-time transforms the monaural frequency signal M[k][n] by using a complex QMF filter bank described by the following equation.

$$IQMF[k][n] = \frac{1}{64}\exp\left(j\frac{\pi}{64}\left(k+\frac{1}{2}\right)(2n-127)\right), \quad 0 \le k < 32,\ 0 \le n < 32 \tag{3}$$

Here, IQMF[k][n] is a complex QMF with time n and frequency k as variables.

When the left frequency signal and the right frequency signal are generated by another time-frequency transform processing such as fast Fourier transform, discrete cosine transform, and modified discrete cosine transform, the frequency-time transform unit 13 uses the inverse transform of the time-frequency transform used for calculating the left and right frequency signals.

The frequency-time transform unit 13 outputs a monaural signal Mt[n] obtained by frequency-time transforming the monaural frequency signal M[k][n] to the AAC encoding unit 15.

The SBR encoding unit 14 is an example of a low channel encoding unit, and every time the SBR encoding unit 14 receives the monaural frequency signal, the SBR encoding unit 14 encodes a high frequency component of the monaural frequency signal which is a component included in a high frequency range in accordance with the SBR encoding method. In this way, the SBR encoding unit 14 generates an SBR code which is an example of low channel audio code.

For example, the SBR encoding unit 14 duplicates a low frequency component of the monaural frequency signal having a strong correlation with a high frequency component that is a target of the SBR encoding. As a duplication method, for example, a method disclosed in Japanese Laid-open Patent Publication No. 2008-224902 can be used. The low frequency component is a component of the monaural frequency signal included in a frequency range lower than a high frequency range including the high frequency component that is encoded by the SBR encoding unit 14, and encoded by the AAC encoding unit 15 described below. The SBR encoding unit 14 adjusts an electric power of the duplicated high frequency component so that the electric power corresponds to an electric power of the original high frequency component. The SBR encoding unit 14 defines a component of the original high frequency component which is largely different from the low frequency component and cannot be approximated by the low frequency component even if the low frequency component is duplicated, as auxiliary information. The SBR encoding unit 14 quantizes information representing positional relationship between the duplicated low frequency component and corresponding high frequency component, electric power adjustment amount, and the auxiliary information, and encodes them.

The SBR encoding unit 14 outputs an SBR code which is the encoded information described above to the multiplexing unit 17.

The AAC encoding unit 15 is an example of a low channel encoding unit, and every time the AAC encoding unit 15 receives the monaural signal, the AAC encoding unit 15 generates an AAC code which is an example of a low channel audio code by encoding a low frequency component in accordance with an AAC encoding method. As the AAC encoding unit 15, for example, a technique disclosed in Japanese Laid-open Patent Publication No. 2007-183528 can be used. Specifically, the AAC encoding unit 15 regenerates the monaural frequency signal by performing a discrete cosine transform on the received monaural signal. The AAC encoding unit 15 calculates perceptual entropy (PE) from the regenerated monaural frequency signal. The PE represents an information amount necessary for quantizing a noise block so that a listener does not perceive the noise. The PE has a characteristic of having a large value for a sound, whose signal level changes in a short time period, such as an attacking sound generated by a percussion instrument. Therefore, the AAC encoding unit 15 shortens window for a frame having a relatively large PE value, and lengthens window for a block having a relatively small PE value. For example, a short window includes 256 samples, and a long window includes 2048 samples. The AAC encoding unit 15 transforms the monaural signal into a set of MDCT coefficients by performing a modified discrete cosine transform (MDCT) on the monaural signal by using a window with a determined length.

The AAC encoding unit 15 quantizes the set of MDCT coefficients, and transforms the set of quantized MDCT coefficients into a variable-length code.

The AAC encoding unit 15 outputs the set of MDCT coefficients which are transformed into a variable-length code and related information such as quantized coefficients to the multiplexing unit 17 as an AAC code.

Every time the PS encoding unit 16 receives the left frequency signal and the right frequency signal which are calculated frame by frame, the PS encoding unit 16 calculates space information from the left frequency signal and the right frequency signal, and generates a PS code by encoding the space information. Therefore, the PS encoding unit 16 includes a space information extraction unit 21, an importance calculation unit 22, a similarity correction unit 23, an intensity difference correction unit 24, a similarity quantization unit 25, an intensity difference quantization unit 26, a correction width control unit 27, and a PS code generation unit 28.

The space information extraction unit 21 calculates similarity between the left frequency signal and the right frequency signal which are information representing a spread of sound, and intensity difference between the left frequency signal and the right frequency signal which are information representing localization of sound. For example, the space information extraction unit 21 calculates similarity ICC(k) and intensity difference IID(k) in accordance with the following equations.

$$IID(k) = 10\log_{10}\left(\frac{e_L(k)}{e_R(k)}\right) \tag{4}$$

$$ICC(k) = \frac{e_{LR}(k)}{\sqrt{e_L(k)e_R(k)}} \tag{5}$$

$$e_L(k) = \sum_{n=0}^{N-1} |L[k][n]|^2$$

$$e_R(k) = \sum_{n=0}^{N-1} |R[k][n]|^2$$

$$e_{LR}(k) = \sum_{n=0}^{N-1} L[k][n] \cdot R[k][n]$$

N is the number of sample points in the time direction included in one frame, and N is 128 in this embodiment.

The space information extraction unit 21 outputs the calculated similarity to the importance calculation unit 22 and the similarity correction unit 23. The space information extraction unit 21 outputs the calculated intensity difference to the importance calculation unit 22 and the intensity difference correction unit 24.

The importance calculation unit 22 calculates importance of each frequency from the similarity and the intensity difference. The importance represents a degree of how much the space information affects human hearing, and the higher the importance of the space information is, the more the space information affects sound quality of a reproduced stereo signal. Therefore, the larger the similarity is, or the larger the absolute value of the intensity difference is, the higher the importance is.

For example, the importance calculation unit 22 calculates importance w(k) of frequency k in accordance with the following equations.

$$w(k) = \frac{\alpha \cdot ICC_{norm}(k) + \beta \cdot IID_{norm}(k)}{\alpha + \beta} \tag{6}$$

$$ICC_{norm}(k) = \frac{ICC(k) + 1}{2}$$

$$IID_{norm}(k) = |IID(k)| / 50$$

Here, $ICC_{norm}(k)$ is a normalized obtained by normalizing the similarity ICC(k), and has a value of either 0 or 1. $IID_{norm}(k)$ is a normalized intensity difference obtained by normalizing the intensity difference IDD(k), and has a value of either 0 or 1. The intensity difference IDD(k) has a value between −50 dB and +50 dB. Further, α and β are weighting coefficients. For example, it is possible to use the following values: α=1, β=1.

The importance calculation unit 22 outputs importance of each frequency to the similarity correction unit 23 and the intensity difference correction unit 24.

The similarity correction unit 23 is an example of a space information correction unit, and smoothes similarity of frequency smaller than or equal to a predetermined threshold value inputted from the correction width control unit 27 in the frequency direction. The intensity difference correction unit 24 is also an example of the space information correction unit, and smoothes intensity difference of frequency smaller than or equal to a predetermined threshold value inputted from the correction width control unit 27 in the frequency direction.

When similarity for a certain frequency is smoothed, difference between the similarity for the frequency and similarity for a frequency near the frequency becomes small. Therefore, in frequencies in which similarities are smoothed, difference between similarities in the frequency direction becomes small. When a difference of similarities is small, the number of encoded bits allocated to the difference of similarities can be small. Therefore, the similarity correction unit 23 can reduce an amount of encoded data of the space information by smoothing similarity of frequency whose importance is smaller than or equal to a predetermined threshold value in the frequency direction.

In the same way, the intensity difference correction unit 24 can also reduce an amount of encoded data of the space information by smoothing intensity difference of frequency whose importance is smaller than or equal to a predetermined threshold value in the frequency direction.

Figure 2:
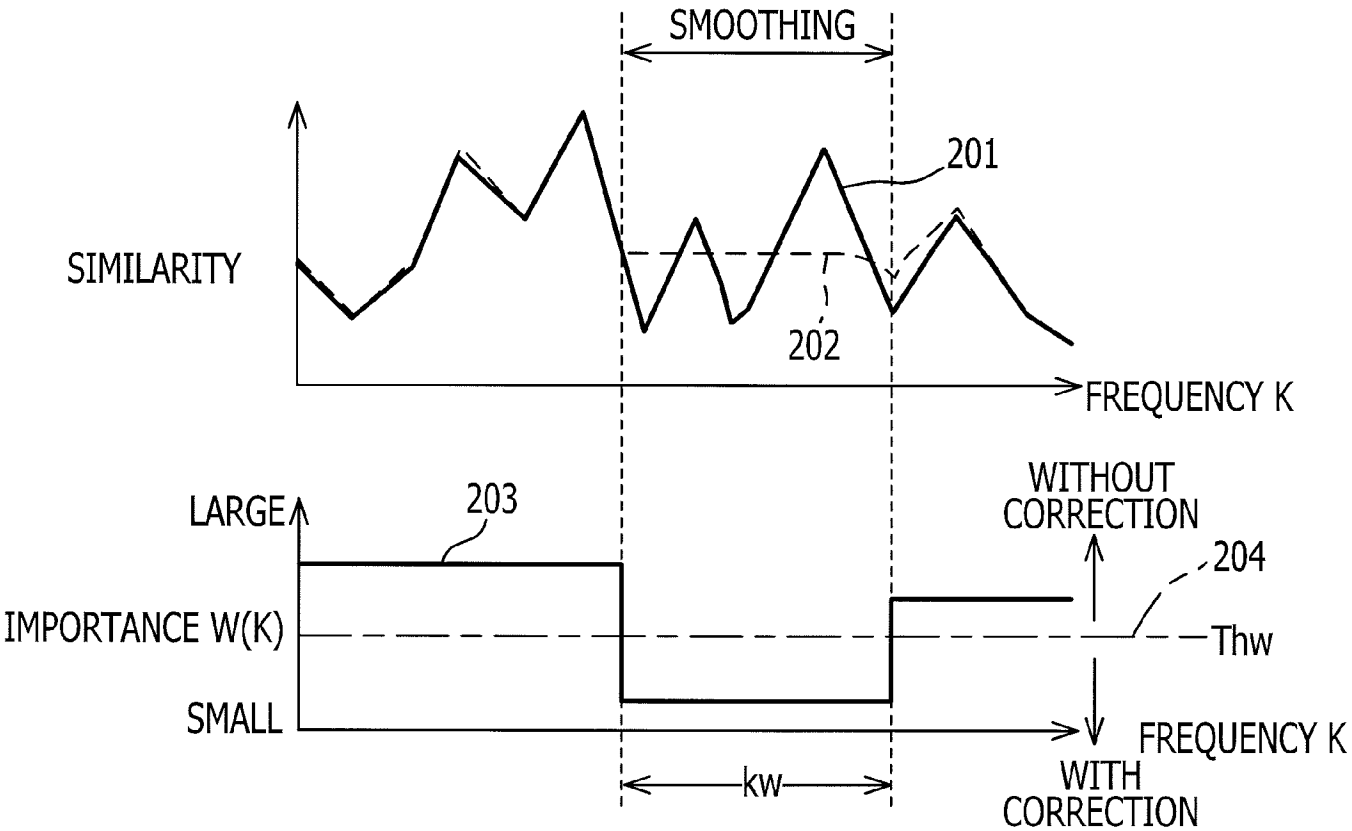
FIG. 2 is a diagram for explaining a relationship between importance and similarity to be smoothed.

FIG. 2 is a diagram for explaining a relationship between importance and similarities to be smoothed. In FIG. 2, the horizontal axes of the upper and lower graphs represent frequency. The vertical axis of the upper graph represents similarity. On the other hand, the vertical axis of the lower graph represents importance. In the upper graph, the broken line 201 represents original similarity ICC(k) before being smoothed, and the broken line 202 represents similarity ICC'(k) after being smoothed. In the lower graph, the broken line 203 represents importance w(k) of frequency k. Further, the dashed-dotted line 204 represents a threshold value Thw.

As shown in FIG. 2, in the frequency band kw, the importance w(k) is lower than the threshold value Thw. Therefore, the similarity correction unit 23 smoothes the similarity ICC (k) of each frequency included in the frequency band kw in the frequency direction.

Hence, in the frequency band kw, a change of the smoothed similarity ICC'(k) with respect to a change of frequency is smaller than a change of the similarity ICC(k) before being corrected.

For example, the similarity correction unit 23 calculates the smoothed similarity ICC'(k) by averaging the similarity ICC(k) in the frequency direction in accordance with the following equation.

$$ICC'(k) = \frac{1}{k_2 - k_1 + 1} \sum_{k=k_1}^{k_2} ICC(k),\ (k = k_1, \ldots, k_2) \tag{7}$$

Here, k1 represents the lower limit value of the frequency band in which the similarity is smoothed, and k2 represents the upper limit value of the frequency band in which the similarity is smoothed. When there are a plurality of frequency bands in which the importance w(k) is smaller than the threshold value Thw, the similarity correction unit 23 smoothes the similarity ICC(k) in the plurality of frequency bands by using the equation (7).

Or, the similarity correction unit 23 may smooth the similarity ICC(k) by performing low-pass filter processing on the similarity ICC(k) in the frequency band from k1 to k2 in accordance with the following equation.

$$ICC'(k)=\gamma\cdot ICC(k-1)+(1-\gamma)\cdot ICC(k),\ (k=k_1, \ldots, k_2) \tag{8}$$

Here, γ is a weighting coefficient, and for example, γ is set to 0.9.

Further, the similarity correction unit 23 may use a second or higher order low-pass filter as described by the following equation instead of the equation (8).

$$ICC'(k)=\eta\cdot ICC(k-2)+\zeta\cdot ICC(k-1)+(1-\eta-\zeta)\cdot ICC(k),\ (k=k_1, \ldots, k_2) \tag{9}$$

Here, η, ζ are weighting coefficients, and for example, they are set as η=0.5 and ζ=0.4.

The similarity correction unit 23 outputs the smoothed similarity to the similarity quantization unit 25.

In the same way as the similarity correction unit 23, the intensity difference correction unit 24 can smooth the intensity difference in the frequency direction by averaging the intensity differences in the frequency direction or performing low-pass filter processing on the intensity difference in the frequency band whose importance is smaller than or equal to a predetermined threshold value.

For example, the intensity difference correction unit 24 can calculate the smoothed intensity difference IID'(k) by replacing the similarity ICC(k) by the intensity difference IIC(k) in any one of the above equations (7) to (9).

The intensity difference correction unit 24 outputs the smoothed intensity difference to the intensity difference quantization unit 26.

The similarity quantization unit 25 is an example of a space information encoding unit, and encodes the smoothed similarity as one of space information codes. To do this, the similarity quantization unit 25 refers to a quantization table showing a relationship between similarity values and index values. The similarity quantization unit 25 determines an index value nearest to the smoothed similarity ICC'(k) for each frequency by referring to the quantization table. The quantization table is stored in a memory included in the similarity quantization unit 25 in advance.

FIG. 3 is a diagram showing an example of the quantization table of similarities. In the quantization table 300 shown in FIG. 3, fields in the upper row 310 indicate index values and each field in the lower row 320 indicates a representative value of similarity corresponding to an index value in the same column. The value range of similarity may be from −1 to +1. For example, when the similarity for the frequency k is 0.6, in the quantization table 300, the representative value of similarity corresponding to index 3 is nearest to the similarity for the frequency k. Therefore, the similarity quantization unit 25 sets the index value for the frequency k to 3.

Next, the similarity quantization unit 25 obtains difference between indexes along the frequency direction for each frequency. For example, when the index value for the frequency k is 3 and the index value for the frequency (k−1) is 0, the similarity quantization unit 25 determines that the difference between indexes for the frequency k is 3.

The similarity quantization unit 25 refers to an encoding table showing a relationship between the differences between indexes and similarity codes. The similarity quantization unit 25 determines similarity code idxicc(k) with respect to the difference between indexes for each frequency by referring to the encoding table. The encoding table is stored in a memory included in the similarity quantization unit 25 in advance. The similarity code may be a variable-length code, the length of which shortens as the appearance frequency of the difference increases, such as the Huffman code or the arithmetic code.

FIG. 4 is a diagram showing an example of the table showing the relationship between the differences between indexes and similarity codes. In this example, the similarity codes are the Huffman codes. In the encoding table 400 shown in FIG. 4, fields in the left column indicate the differences between indexes and each field in the right column indicates a similarity code corresponding to the difference between indexes in the same row. For example, when the difference between indexes for the frequency k is 3, the similarity quantization unit 25 sets the similarity code idxicc(k) for the frequency k to "111110" by referring to the encoding table 400.

The similarity quantization unit 25 outputs the similarity codes obtained for each frequency to the correction width control unit 27.

The intensity difference quantization unit 26 is an example of the space information encoding unit, and encodes the smoothed intensity difference as one of the space information codes. To do this, the intensity difference quantization unit 26 refers to a quantization table showing a relationship between intensity difference values and index values. The intensity difference quantization unit 26 determines an index value nearest to the smoothed intensity difference IID'(k) for each frequency by referring to the quantization table. The intensity difference quantization unit 26 obtains difference between indexes along the frequency direction for each frequency. For example, when the index value for the frequency k is 2 and the index value for the frequency (k−1) is 4, the intensity difference quantization unit 26 determines that the difference between indexes for the frequency k is −2.

The intensity difference quantization unit 26 refers to an encoding table showing a relationship between the differences between indexes and intensity difference codes. The intensity difference quantization unit 26 determines an intensity difference code idxiid(k) with respect to the difference for each frequency k by referring to the encoding table. In the same way as the similarity code, the intensity difference code may be a variable-length code, the length of which shortens as the appearance frequency of the difference increases, such as the Huffman code or the arithmetic code.

The quantization table and the encoding table are stored in a memory included in the intensity difference quantization unit 26 in advance.

FIG. 5 is a diagram showing an example of the quantization table for the intensity difference. In the quantization table 500 shown in FIG. 5, fields in the rows 510 and 530 indicate index values, and each field in the rows 520 and 540 indicates a representative value of intensity difference corresponding to an index value shown in a field in the row 510 or 530 in the same column.

For example, when the intensity difference for the frequency k is 10.8 dB, in the quantization table 500, the representative value of intensity difference corresponding to index 4 is nearest to the intensity difference for the frequency k. Therefore, the intensity difference quantization unit 26 sets the index value for the frequency k to 4.

The intensity difference quantization unit 26 outputs the intensity difference codes obtained for each frequency to the correction width control unit 27.

The correction width control unit 27 adjusts the threshold value of importance used in the similarity correction unit 23 and the intensity difference correction unit 24 so that a bit rate of the PS code generated by the PS encoding unit 16 is within a predetermined range.

Figure 6A:
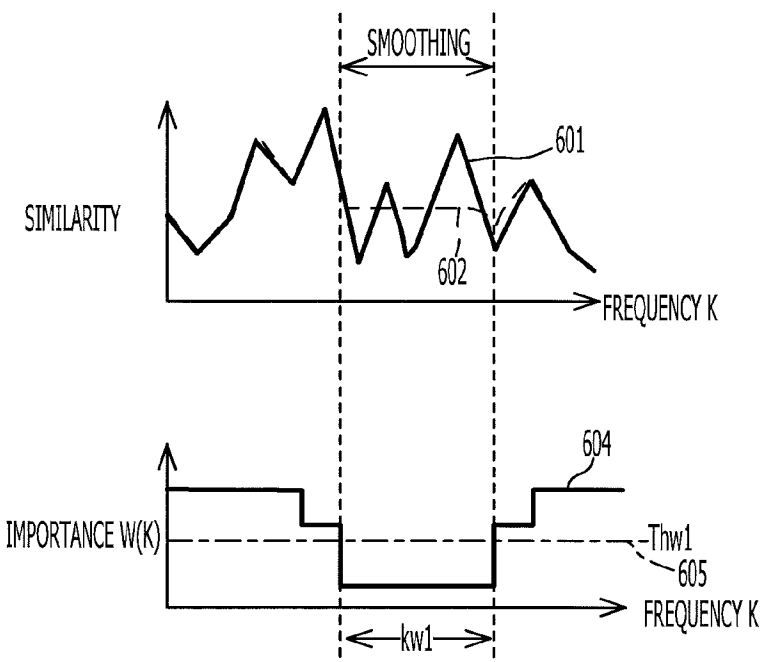
FIGS. 6A and 6B are diagrams for explaining a relationship between importance and similarity to be smoothed when a threshold value is changed.
Figure 6B:
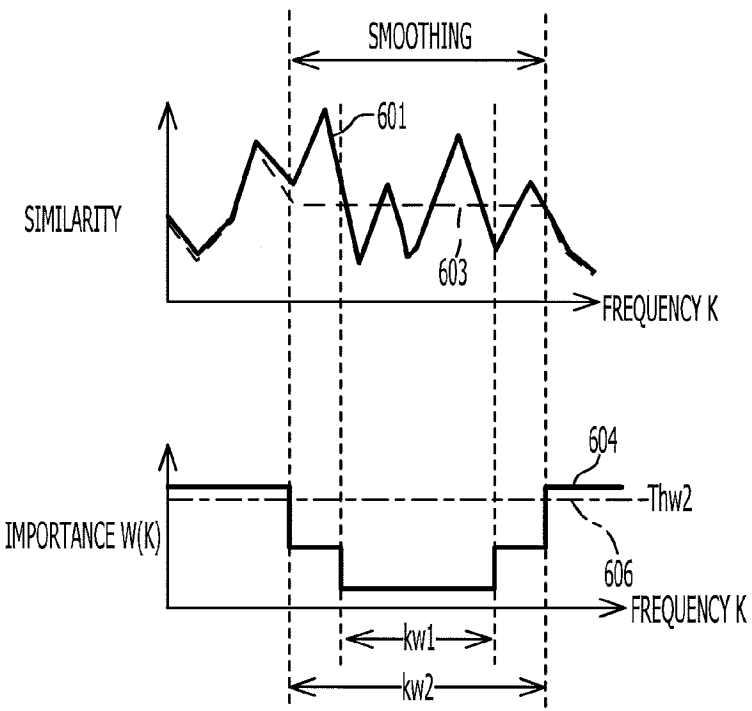

FIGS. 6A and 6B are diagrams for explaining a relationship between importance and similarity to be smoothed when the threshold value is changed. In FIGS. 6A and 6B, the horizontal axes of the upper and lower graphs represent frequency. The vertical axis of the upper graph represents similarity. On the other hand, the vertical axis of the lower graph represents importance. In the upper graphs in FIGS. 6A and 6B, the broken line 601 represents original similarity ICC(k) before being smoothed, and the broken lines 602 and 603 represent similarity ICC'(k) after being smoothed. In the lower graphs in FIGS. 6A and 6B, the broken lines 604 represent importance w(k) of each frequency k. Further, the dashed-dotted lines 605 and 606 represent the threshold value Thw.

As shown in FIG. 6A, when the threshold value is set to Thw1, in the frequency band kw1, the importance w(k) is lower than the threshold value Thw1. In this case, only the similarity ICC(k) of each frequency included in the frequency band kw1 is smoothed. However, since the range of similarity to be smoothed is small, a data amount of similarity code may be too much. On the other hand, as shown in FIG. 6B, when the threshold value is set to Thw2 higher than Thw1, in the frequency band kw2 wider than the frequency band kw1, the importance w(k) is lower than the threshold value Thw2. Therefore, the frequency band in which similarity is smoothed becomes wide. Based on this, the higher the threshold value is, the wider the frequency band in which similarity is smoothed is, so that the data amount of similarity code becomes small. Regarding the intensity difference, the higher the threshold value of importance is, the wider the frequency band in which intensity difference is smoothed is, so that the data amount of intensity difference code becomes small.

Therefore, the correction width control unit 27 calculates a total bit rate of the similarity code received from the similarity quantization unit 25 and the intensity difference code received from the intensity difference quantization unit 26.

At this time, the correction width control unit 27 calculates bit lengths of the similarity code and the intensity difference code respectively, and obtains the sum of them to calculate the total bit rate.

Or, the correction width control unit 27 may calculate the total bit rate by referring to a table showing the bit lengths of the similarity code and the intensity difference code and obtaining the bit lengths of these codes.

When the total bit rate is greater than a predetermined upper limit value, the correction width control unit 27 increases the threshold value of importance. For example, the correction width control unit 27 multiplies the threshold value Thw by 1.1 to modify the threshold value Thw. Then, the correction width control unit 27 sends the modified threshold value Thw to the similarity correction unit 23 and the intensity difference correction unit 24. The correction width control unit 27 discards the similarity code and the intensity difference code. The PS encoding unit 16 causes the similarity correction unit 23 and the intensity difference correction unit 24 to smooth the similarity and the intensity difference again by using the modified threshold value Thw and causes the similarity quantization unit 25 and the intensity difference quantization unit 26 to obtain the similarity code and the intensity difference code again.

On the contrary, when the total bit rate of the similarity code and the intensity difference code is too small, the space information may be excessively lost. In this case, sound quality when reproducing the stereo signal encoded by the audio encoding device 1 may deteriorate excessively. When the total bit rate of the similarity code and the intensity difference code is smaller than a predetermined lower limit value, the correction width control unit 27 decreases the threshold value of importance. For example, the correction width control unit 27 multiplies the threshold value Thw by 0.95 to modify the threshold value Thw. In this case, also the correction width control unit 27 sends the modified threshold value Thw to the similarity correction unit 23 and the intensity difference correction unit 24. The correction width control unit 27 discards the similarity code and the intensity difference code. The PS encoding unit 16 causes the similarity correction unit 23 and the intensity difference correction unit 24 to smooth the similarity and the intensity difference again by using the modified threshold value Thw and causes the similarity quantization unit 25 and the intensity difference quantization unit 26 to obtain the similarity code and the intensity difference code again.

The predetermined upper limit value is preferred to be an upper limit value of bit rate that can be allocated to the PS code when all the SBR code and the AAC code are transmitted. The predetermined lower limit value is preferred to be set to an allowable lower limit of bit rate at which a listener does not perceive deterioration of sound reproduced from the stereo signal encoded by the audio encoding device 1.

For example, when the audio encoding device 1 encodes a stereo signal having a frequency band of 48 kHz at a bit rate of 32 kbps in accordance with the HE-AAC ver.2 method, the upper limit value is set to any rate from 3 to 5 kbps, for example, set to 4 kbps. On the other hand, the lower limit value is set to any rate from 0 to 1 kbps, for example, set to 0.1 kbps.

When the total bit rate of the similarity code and the intensity difference code is in a range between the predetermined lower limit value and the predetermined upper limit value, the correction width control unit 27 outputs the similarity code and the intensity difference code to the PS code generation unit 28.

The PS code generation unit 28 generates the PS code by using the similarity code idxicc(k) and the intensity difference code idxiid(k) received from the correction width control unit 27. For example, the PS code generation unit 28 generates the PS code by arranging the similarity code idxicc (k) and the intensity difference code idxiid(k) in a predetermined sequence. The predetermined sequence is described, for example, in ISO/IEC 14496-3:2005, 8.4 "Payloads for the audio object type SSC".

The PS code generation unit 28 outputs the generated the PS code to the multiplexing unit 17.

Figure 7:
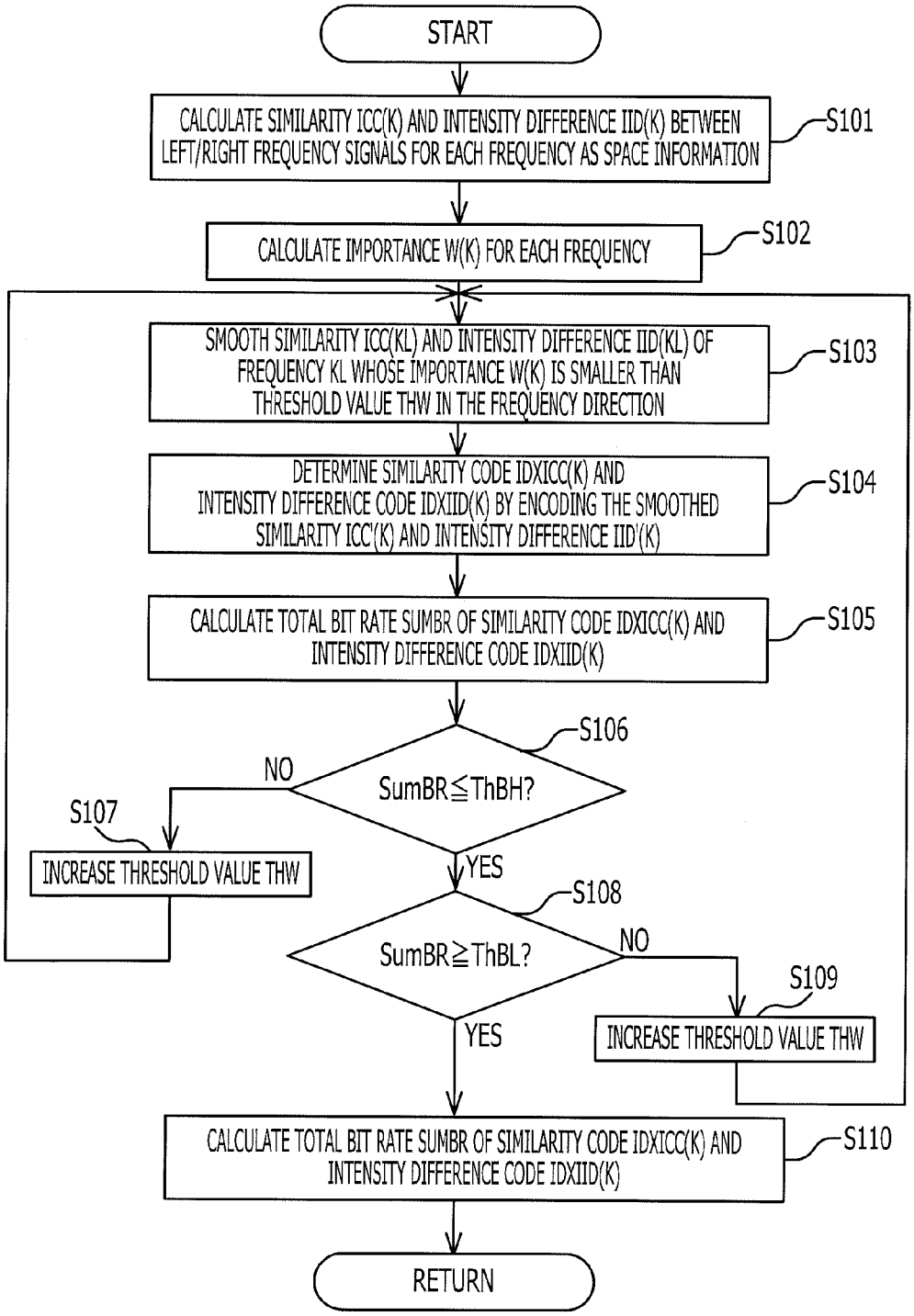
FIG. 7 is a flowchart showing an operation of PS code generation processing.

FIG. 7 shows an operation flowchart of PS code generation processing. The flowchart shown in FIG. 7 represents processing on a stereo frequency signal of one frame. The PS encoding unit 16 performs the PS code generation processing shown in FIG. 7 every time the left stereo frequency signal and the right stereo frequency signal are inputted.

First, the space information extraction unit 21 calculates the similarity ICC(k) and the intensity difference IID(k) between the left and right frequency signals for each frequency as space information (step S101). The space information extraction unit 21 outputs the calculated similarity to the importance calculation unit 22 and the similarity correction unit 23. The space information extraction unit 21 outputs the calculated intensity difference to the importance calculation unit 22 and the intensity difference correction unit 24.

Next, the importance calculation unit 22 calculates importance w(k) for each frequency on the basis of the similarity ICC(k) and the intensity difference IID(k) (step S102). The importance calculation unit 22 outputs the importance of each frequency to the similarity correction unit 23 and the intensity difference correction unit 24.

The similarity correction unit 23 smoothes similarity ICC (kl) of frequency kl whose importance w(k) is smaller than the threshold value Thw in the frequency direction. In the same way, the intensity difference correction unit 24 smoothes intensity difference IID(kl) of frequency kl whose importance w(k) is smaller than the threshold value Thw in the frequency direction (step S103). The similarity correction unit 23 outputs the smoothed similarity ICC'(k) to the similarity quantization unit 25. The intensity difference correction unit 24 outputs the smoothed intensity difference IID'(k) to the intensity difference quantization unit 26.

The similarity quantization unit 25 determines similarity code idxicc(k) by encoding the smoothed similarity ICC'(k). The intensity difference quantization unit 26 determines intensity difference code idxiid(k) by encoding the smoothed intensity difference IID'(k) (step S104). The similarity quantization unit 25 outputs the similarity code idxicc(k) obtained for each frequency to the correction width control unit 27. The intensity difference quantization unit 26 outputs the intensity difference code idxiid(k) obtained for each frequency to the correction width control unit 27.

Thereafter, the correction width control unit 27 calculates the total bit rate SumBR of the similarity code idxicc(k) and the intensity difference code idxiid(k) (step S105). The correction width control unit 27 determines whether or not the total bit rate SumBR is smaller than or equal to an upper limit value $Th_{BH}$ (step S106). When the total bit rate SumBR is greater than the upper limit value $Th_{BH}$ (step S106: No), the correction width control unit 27 increases the threshold value Thw (step S107). Then, the correction width control unit 27 sends the modified threshold value Thw to the similarity correction unit 23 and the intensity difference correction unit 24. The PS encoding unit 16 repeats processing from step S103 to step S107 until the total bit rate SumBR becomes smaller than or equal to the upper limit value $Th_{BH}$.

On the other hand, in step S106, when the total bit rate SumBR is smaller than or equal to the upper limit value $Th_{BH}$ (step S106: Yes), the correction width control unit 27 determines whether or not the total bit rate SumBR is greater than or equal to an lower limit value $Th_{BL}$ (step S108). When the total bit rate SumBR is smaller than the lower limit value $Th_{BL}$ (step S108: No), the correction width control unit 27 decreases the threshold value Thw (step S109). In this case, to prevent the process from going into an infinite loop, it is preferable that the correction width control unit 27 modifies the threshold value Thw by an amount smaller than an amount by which the correction width control unit 27 modifies the threshold value Thw in step S107. The correction width control unit 27 sends the modified threshold value Thw to the similarity correction unit 23 and the intensity difference correction unit 24. The PS encoding unit 16 repeats processing from step S103 to step S109 until the total bit rate SumBR becomes greater than or equal to the lower limit value $Th_{BL}$.

On the other hand, in step S108, when the total bit rate SumBR is greater than or equal to the lower limit value $Th_{BL}$ (step S108: Yes), the correction width control unit 27 outputs the similarity code idxicc(k) and the intensity difference code idxiid(k) to the PS code generation unit 28.

The PS code generation unit 28 generates the PS code by arranging the similarity code idxicc(k) and the intensity difference code idxiid(k) in a predetermined sequence (step S110).

The PS code generation unit 28 outputs the PS code to the multiplexing unit 17. Then, the PS encoding unit 16 ends the PS code generation processing.

The lower limit value $Th_{BL}$ may be set to 0. In this case, processing of steps S108 and S109 is omitted.

The multiplexing unit 17 multiplexes the AAC code, the SBR code, and the PS code by arranging these codes in a predetermined sequence. The multiplexing unit 17 outputs an encoded stereo signal generated by the multiplexing.

Figure 8:
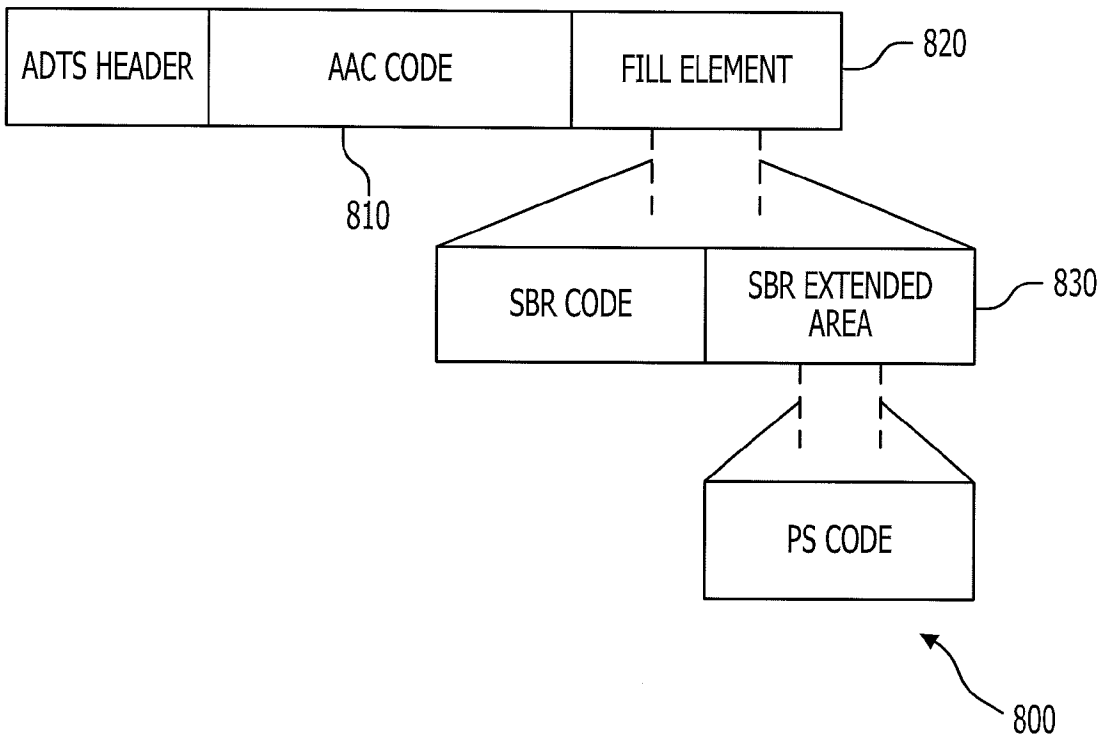
FIG. 8 is a diagram showing an example of a format of data in which an encoded stereo signal is stored.

FIG. 8 is a diagram showing an example of a format of data in which the encoded stereo signal is stored. In this example, the encoded stereo signal is created in accordance with a format of MPEG-4 ADTS (Audio Data Transport Stream).

In an encoded data string 800 shown in FIG. 8, the AAC code is stored in a data block 810. The SBR code and the PS code are stored in a part of area of a block 820 in which a FILL element of ADTS format is stored. In particular, the PS code is stored in an SBR extended area 830 in the SBR code.

Figure 9:
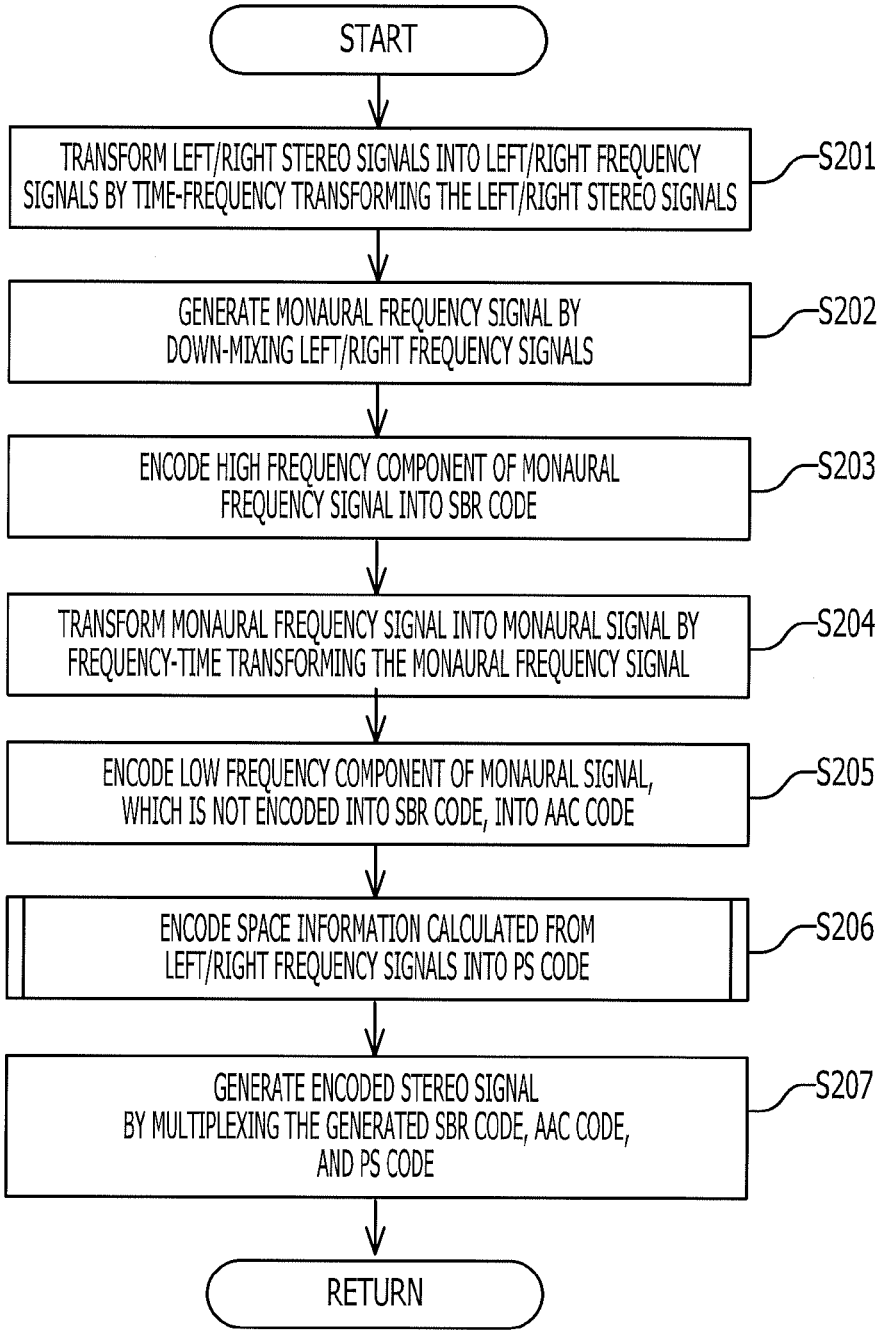
FIG. 9 is a flowchart showing an operation of audio encoding processing.

FIG. 9 shows an operation flowchart of audio encoding processing. The flowchart shown in FIG. 9 represents processing on a stereo signal of one frame. While receiving a stereo signal, the audio encoding device 1 repeatedly perform the procedure of audio encoding processing shown in FIG. 9 for each frame.

The time-frequency transform unit 11*a* transforms a left stereo signal of an inputted stereo signal into a left frequency signal by time-frequency transforming the left stereo signal. The time-frequency transform unit 11*b* transforms a right stereo signal of the inputted stereo signal into a right frequency signal by time-frequency transforming the right stereo signal (step S201). The time-frequency transform unit 11*a* outputs the left frequency signal to the down-mix unit 12 and the PS encoding unit 16. In the same way, the time-frequency transform unit 11*b* outputs the right frequency signal to the down-mix unit 12 and the PS encoding unit 16.

Next, the down-mix unit 12 generates a monaural frequency signal, which has the number of channels smaller than that of the stereo signal, by down-mixing the left frequency signal and the right frequency signal (step S202). The down-mix unit 12 outputs the monaural frequency signal to the frequency-time transform unit 13 and the SBR encoding unit 14.

The SBR encoding unit 14 encodes a high frequency component of the monaural frequency signal into an SBR code (step S203). The SBR encoding unit 14 outputs the SBR code, which includes information representing positional relationship between a low frequency component used for duplication and corresponding high frequency component and the like, to the multiplexing unit 17.

The frequency-time transform unit 13 transforms the monaural frequency signal into a monaural signal by frequency-time transforming the monaural frequency signal (step S204). The frequency-time transform unit 13 outputs the monaural signal to the AAC encoding unit 15.

The AAC encoding unit 15 encodes a low frequency component of the monaural signal, which is not encoded into an SBR code by the SBR encoding unit 14, into an AAC code (step S205). The AAC encoding unit 15 outputs the AAC code to the multiplexing unit 17.

The PS encoding unit 16 calculates space information from the left frequency signal and the right frequency signal. Then, the PS encoding unit 16 encodes the calculated space information into a PS code (step S206). The PS encoding unit 16 outputs the PS code to the multiplexing unit 17.

Finally, the multiplexing unit 17 generates an encoded stereo signal by multiplexing the generated SBR code, AAC code, and PS code (step S207).

The multiplexing unit 17 outputs the encoded stereo signal. Then, the audio encoding device 1 ends the encoding processing.

The audio encoding device 1 may perform processing of steps S202 to S205 and processing of step S206 in parallel. Or, the audio encoding device 1 may perform processing of step S206 before performing processing of steps S202 to S205.

Figures 10A, 10B, 10C:
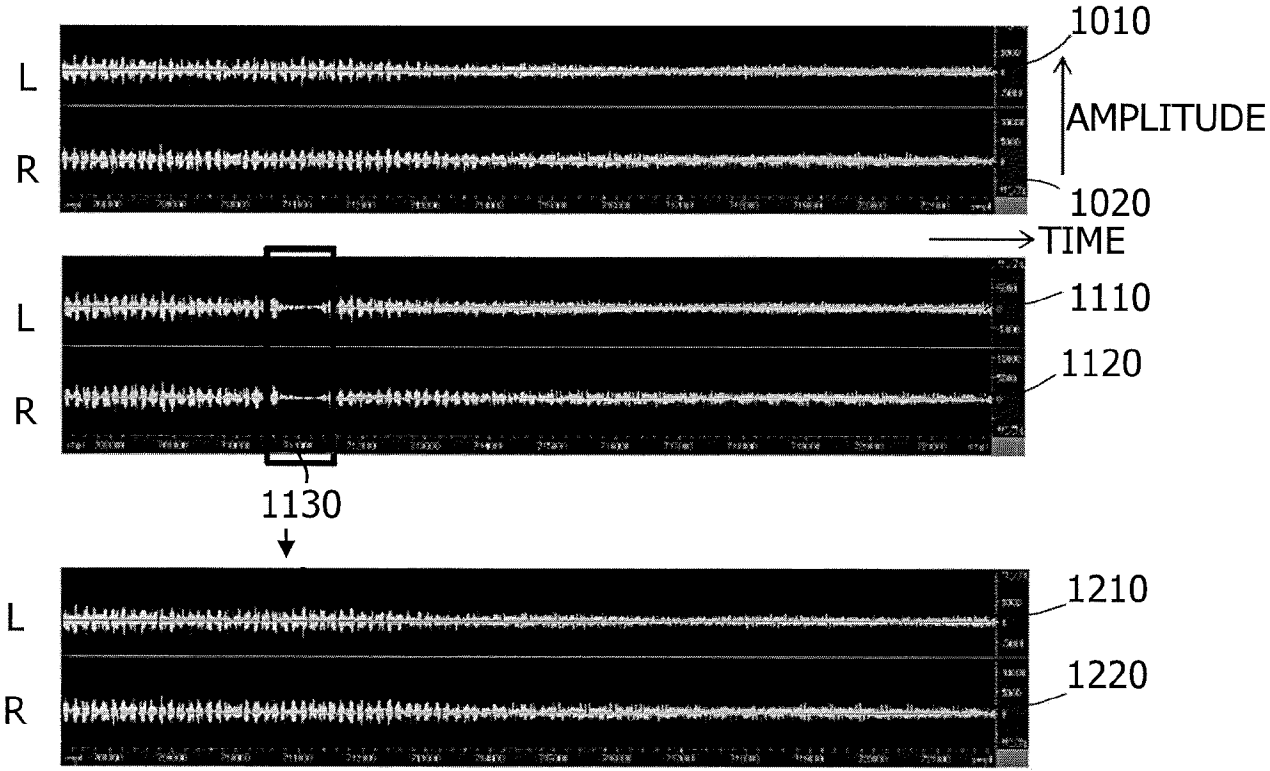
FIG. 10A is a diagram showing an example of a waveform of an original audio signal.
FIG. 10B is a diagram showing an example of a waveform obtained by reproducing an audio signal encoded by a parametric stereo coding method of a conventional technique, and 10C is a diagram showing an example of a waveform obtained by reproducing an audio signal encoded by the audio encoding device according to the embodiment.

FIG. 10A is a diagram showing an example of a waveform of an original stereo signal in which the sound of a glockenspiel is recorded. FIG. 10B is a diagram showing an example of a waveform reproduced from a stereo signal encoded with a fixed bit rate 32 kbps by a parametric stereo coding method of a conventional technique. FIG. 100 is a diagram showing an example of a waveform reproduced from a stereo signal encoded with a fixed bit rate 32 kbps by the audio encoding device 1 according to the embodiment.

In FIGS. 10A to 10C, the horizontal axis represents time, and the vertical axis represents amplitude. In FIG. 10A, the upper waveform 1010 is a waveform of an original left stereo signal and the lower waveform 1020 is a waveform of an original right stereo signal. In FIG. 10B, the upper waveform 1110 is a waveform of a left stereo signal reproduced from a stereo signal encoded by the parametric stereo coding method of a conventional technique. On the other hand, the lower waveform 1120 is a waveform of a right stereo signal reproduced from the stereo signal encoded by the parametric stereo coding method of a conventional technique. Further, in FIG. 10C, the upper waveform 1210 is a waveform of a left stereo signal reproduced from a stereo signal encoded by the audio encoding device 1. On the other hand, the lower waveform 1220 is a waveform of a right stereo signal reproduced from the stereo signal encoded by the audio encoding device 1.

In FIG. 10A, the waveforms 1010 and 1020 have a certain level of temporally continuous amplitude. In other words, the original stereo signal is a continuous sound. However, in FIG. 10B, the amplitudes of the waveforms 1110 and 1120 are near 0 in a time zone 1130. In other words, the sound disappears in the time zone 1130. In this way, a part of data is lost from the stereo signal encoded by the parametric stereo coding method of a conventional technique.

On the other hand, in FIG. 10C, in the same way as the waveforms 1010 and 1020, the waveforms 1210 and 1220 have a certain level of temporally continuous amplitude. Based on this, it is known that an original stereo signal can be well reproduced by decoding a stereo signal encoded by the audio encoding device 1.

As described above, the audio encoding device reduces a bit rate of the PS code by smoothing space information which is small and in a frequency band not important for human hearing in the frequency direction. Therefore, the audio encoding device can increase a bit rate that can be allocated to the AAC code and the SBR code. Hence, the audio encoding device can reduce an amount of encoded data of the stereo signal without deteriorating the sound quality of the reproduced stereo signal.

The present invention is not limited to the above embodiment. According to another embodiment, the audio encoding device may encode a monaural frequency signal in accordance with another encoding method. For example, the audio encoding device may encode an entire monaural frequency signal in accordance with the AAC encoding method. In this case, in the audio encoding device shown in FIG. 1, the SBR encoding unit is omitted.

The threshold value Thw of importance may be fixed. In this case, the correction width control unit is omitted. The similarity quantization unit directly outputs the similarity code to the PS code generation unit. In the same way, the intensity difference quantization unit directly outputs the intensity difference code to the PS code generation unit.

According to further another embodiment, to obtain importance, the importance calculation unit of the PS encoding unit may change a weighting coefficient for the similarity and the intensity difference of a target frame on the basis of a data amount of the similarity code and the intensity difference code of a frame previous to the target frame.

Figure 11:
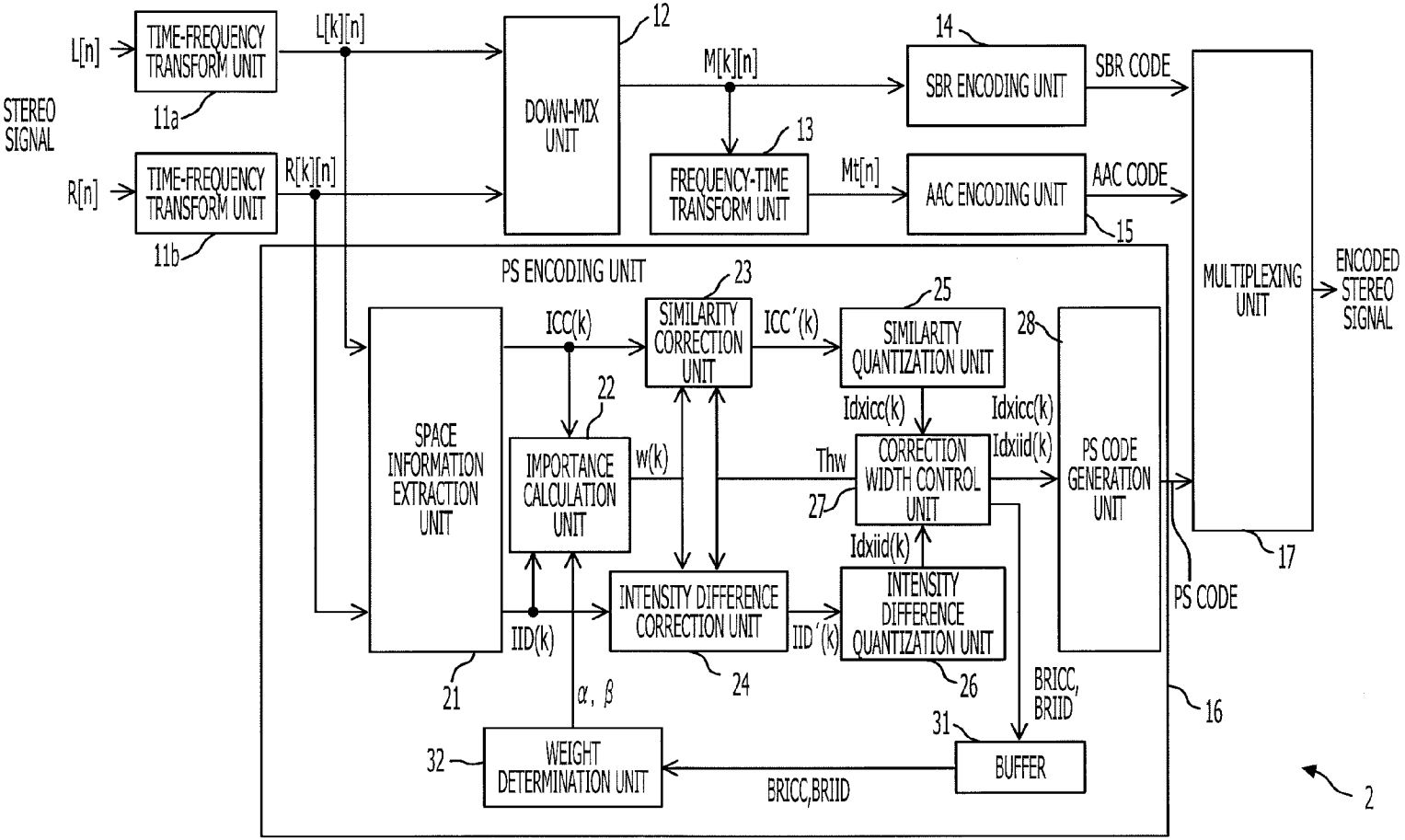
FIG. 11 is a schematic configuration diagram of an audio encoding device according to another embodiment.

FIG. 11 is a schematic configuration diagram of an audio encoding device according to another embodiment. To each constituent element of the audio encoding device 2 shown in FIG. 11, the same reference numeral as that of the corresponding constituent element in the audio encoding device 1 shown in FIG. 1 is given. The related to calculating importance is different from the audio encoding device 1 in a point that the audio encoding device 2 includes a buffer 31 and a weight determination unit 32 for determining a weighting coefficient used to calculate importance. Hereinafter, units related to calculating importance will be described. Refer to the description of the audio encoding device 1 for other points of the audio encoding device 2.

Every time the correction width control unit 27 outputs the similarity code and the intensity difference code for each frame, the buffer 31 receives a bit rate BRICCi of the similarity code and a bit rate BRIIDi of the intensity difference code. Here, i is a frame number. The buffer 31 stores the bit rate of the similarity code and the bit rate of the intensity difference code.

The weight determination unit 32 determines weighting coefficients α, β used to calculate importance in the above equation (6) on the basis of a bit rate of the similarity code and a bit rate of the intensity difference code calculated for a previous frame. When the weight determination unit 32 is notified by the space information extraction unit 21 that the left and right frequency signals for the current frame are inputted, the weight determination unit 32 reads from the buffer 31 a bit rate $BRICC_{t-1}$ of the similarity code and a bit rate $BRIID_{t-1}$ of the intensity difference code which are calculated for a frame (t−1) one frame previous to the current frame t which will be encoded into a PS code.

Generally, property of space information changes temporally slowly. Therefore, it is considered that there is a certain level of correlation between previous space information and current space information. Hence, when a data amount of similarity code is larger than a data amount of intensity difference code in a frame previous to the current frame, it is highly likely that similarity is more important than intensity difference for hearing in the current frame. On the contrary, when a data amount of similarity code is smaller than a data amount of intensity difference code in a frame previous to the current frame, it is highly likely that intensity difference is more important than similarity for hearing in the current frame.

Therefore, the weight determination unit 32 selects one having a larger encoded data amount from similarity and intensity difference in a frame previous to the current frame, and sets a larger weighting coefficient to the one having a larger encoded data amount.

For example, when the bit rate $BRICC_{t-1}$ of the similarity code is larger than the bit rate $BRIID_{t-1}$ of the intensity difference code, the weight determination unit 32 sets a similarity weight α that is a weighting coefficient for similarity to a value greater than 1, for example, 1.2, and sets an intensity difference weight β that is a weighting coefficient for intensity difference to a value smaller than 1, for example, 0.8.

On the contrary, when the bit rate $BRICC_{t-1}$ of the similarity code is smaller than the bit rate $BRIID_{t-1}$ of the intensity difference code, the weight determination unit 32 sets the similarity weight α to a value smaller than 1, for example, 0.8, and sets the intensity difference weight β to a value greater than 1, for example, 1.2.

When the bit rate $BRICC_{t-1}$ of the similarity code is equal to the bit rate $BRIID_{t-1}$ of the intensity difference code, the weight determination unit 32 sets both the similarity weight α and the intensity difference weight β to 1.

The weight determination unit 32 may determine the similarity weight α and the intensity difference weight β so that difference between the similarity weight α and the intensity difference weight β increases as difference between the bit rate $BRICC_{t-1}$ of the similarity code and the bit rate $BRIID_{t-1}$ of the intensity difference code increases. However, to normalize the value of importance w(k), it is preferred that the sum of α and β is always equal to a constant value, for example, 2.

The weight determination unit 32 outputs the similarity weight α and the intensity difference weight β to the importance calculation unit 22.

The importance calculation unit 22 calculates the importance w(k) for each frequency by substituting the similarity weight α and the intensity difference weight β received from the weight determination unit 32 into the equation (6).

As described above, when calculating the importance, the audio encoding device 2 sets a larger weight coefficient to the similarity or the intensity difference which has a larger encoded data amount in the previous frame. Based on this, as the similarity weight increases, contribution of the similarity to the importance increases, and as the intensity difference weight increases, contribution of the intensity difference to the importance increases. Therefore, the audio encoding device 2 can more appropriately evaluate auditory importance, and thus the audio encoding device 2 can more appropriately set a frequency band of the space information to be smoothed. Hence, the audio encoding device 2 can reduce a degree of deterioration of sound quality due to encoding the stereo signal.

Further, in each embodiment described above, the PS encoding unit 16 may smooth either one of the similarity and the intensity difference at a frequency whose importance is smaller than a predetermined threshold value.

Further, in each embodiment described above, the correction width control unit 27 may sets the difference between the total bit rate of the SBR code and the AAC code and a maximum transmission bit rate as an upper limit value of the total bit rate of the similarity code and the intensity difference code. In this case, the audio encoding device performs the SBR encoding processing by the SBR encoding unit and the AAC encoding processing by the AAC encoding unit on a stereo signal of the same frame in advance. The correction width control unit is notified of the bit rate of the SBR code by the SBR encoding unit and notified of the bit rate of the AAC code by the AAC encoding unit, and thereafter, the correction width control unit determines the upper limit value.

Or, the correction width control unit may determine the upper limit value by using the total bit rate of the SBR code and the AAC code in the previous frame instead of using the total bit rate of the SBR code and the AAC code in the same frame.

The audio signal to be encoded is not limited to a stereo signal. For example, the audio signal to be encoded may be an audio signal having a plurality of channels such as 3.1 channels or 5.1 channels. Also, in this case, the audio encoding device calculates a frequency signal of each channel by time-frequency transforming the audio signal of each channel. The audio encoding device generates a frequency signal having channels, the number of which is smaller than that of the original audio signal by down-mixing the frequency signals of each channel. Thereafter, the audio encoding device encodes the down-mixed frequency signal in accordance with the AAC encoding method and the SBR encoding method. On the other hand, the audio encoding device calculates similarity and intensity difference between channels as space information for each channel, and calculates importance of the space information in the same way as described above. In the same way as in the embodiments described above, the audio encoding device smoothes the space information at a frequency whose importance is smaller than a predetermined threshold value in the frequency direction, and then encodes the space information into the PS code.

The audio encoding devices in the above embodiments are installed in various devices used to transmit or record an audio signal, such as a computer, a recording device of video signal, or a video transmission device.

Figure 12:
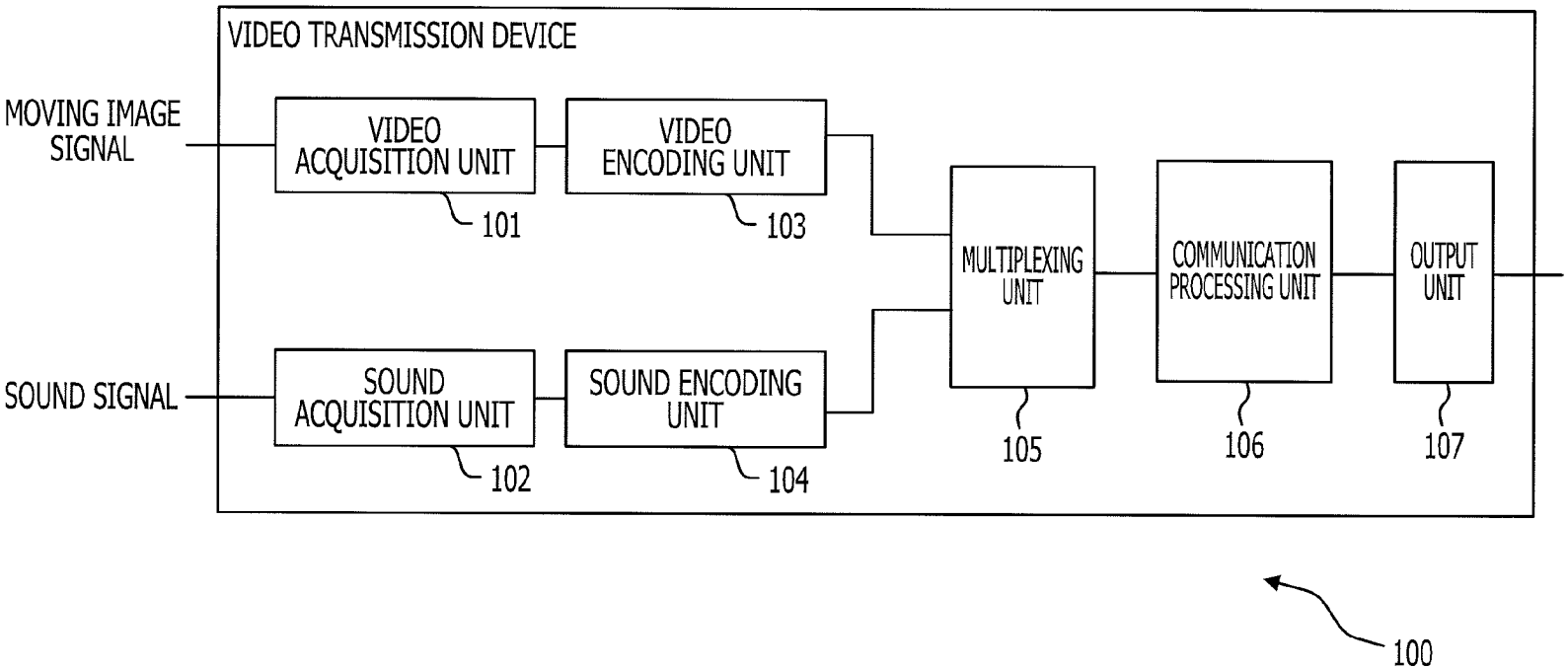
FIG. 12 is a schematic configuration diagram of a video transmission device in which an audio encoding device according to any one of the embodiments is mounted.

FIG. 12 is a schematic configuration diagram of a video transmission device in which an audio encoding device according to any one of the above embodiments is mounted. A video transmission device 100 includes a video acquisition unit 101, a sound acquisition unit 102, a video encoding unit 103, a sound encoding unit 104, a multiplexing unit 105, a communication processing unit 106, and an output unit 107.

The video acquisition unit 101 includes an interface circuit for acquiring a moving image signal from another device such as a video camera. The video acquisition unit 101 sends the moving image signal inputted into the video transmission device 100 to the video encoding unit 103.

The sound acquisition unit 102 includes an interface circuit for acquiring a stereo sound signal from another device such as a microphone. The sound acquisition unit 102 sends the stereo sound signal inputted into the video transmission device 100 to the sound encoding unit 104.

The video encoding unit 103 encodes the moving image signal so as to compress a data amount of the moving image signal. The video encoding unit 103 encodes the moving image signal in accordance with a moving image encoding specification such as, for example, MPEG-2, MPEG-4, and H.264 MPEG-4 Advanced Video Coding (H.264 MPEG-4 AVC). The video encoding unit 103 outputs the encoded moving image data to the multiplexing unit 105.

The sound encoding unit 104 includes an audio encoding device according to any one of the above embodiments. The sound encoding unit 104 generates a monaural signal and space information from the stereo sound signal. The sound encoding unit 104 encodes the monaural signal by the AAC encoding processing and the SBR encoding processing. The sound encoding unit 104 encodes the space information by the PS encoding processing. The sound encoding unit 104 generates encoded audio data by multiplexing the generated AAC code, SBR code, and PS code. The sound encoding unit 104 outputs the encoded audio data to the multiplexing unit 105.

The multiplexing unit 105 multiplexes the encoded moving image data and the encoded audio data. The multiplexing unit 105 creates a stream compliant with a predetermined format for transmitting video data, such as an MPEG-2 transport stream.

The multiplexing unit 105 output the stream in which the encoded moving image data and the encoded audio data are multiplexed to the communication processing unit 106.

The communication processing unit 106 divides the stream in which the encoded moving image data and the encoded audio data are multiplexed into packets compliant with a predetermined communication specification such as TCP/IP. The communication processing unit 106 adds a predetermined header in which destination information and the like are stored to each packet. Then, the communication processing unit 106 sends the packets to the output unit 107.

The output unit 107 includes an interface circuit for connecting the video transmission device 100 to a communication line. The output unit 107 outputs the packets received from the communication processing unit 106 to the communication line.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM, ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW. An example of communication media includes a carrier-wave signal.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An audio encoding device, comprising:

a processor; and a memory that stores a plurality of instructions, which when executed by the processor causes the processor to execute;

transforming signals of channels included in an audio signal having a first number of channels into frequency signals, respectively, by time-frequency transforming the signals of the channels frame by frame, each frame having a predetermined time length;

generating an audio frequency signal having a second number of channels, which is smaller than the first number of channels, by down-mixing the frequency signals of the channels;

generating a low channel audio code by encoding the audio frequency signal;

extracting space information representing spatial information of a sound from the frequency signals of the channels;

calculating an importance representing a degree of how much the space information affects human hearing for each frequency based on the space information;

correcting the space information so that the space information at a frequency band having an importance smaller than a predetermined threshold value is equalized to an adjacent frequency band direction;

generating a space information code by encoding a difference of space information obtained by calculating a difference of values of the corrected space information in the adjacent frequency band direction; and generating an encoded audio signal by multiplexing the low channel audio code and the space information code.

2. The audio encoding device according to claim 1, wherein the processor further executes:

increasing the predetermined threshold value when a data amount of the generated space information code is greater than a predetermined upper limit value;

re-correcting the space information so that the space information at a frequency band having an importance smaller than the increased threshold value is equalized to the adjacent frequency band direction;

re-generating the space information code based on the re-corrected space information; and generating the encoded audio signal by multiplexing the low channel audio code and the re-generated space information code.

3. The audio encoding device according to claim 2, wherein the processor further executes:

determining the upper limit value by subtracting a data amount of the low channel audio code from a pre-set maximum transmission data amount.

4. The audio encoding device according to claim 2, wherein the processor further executes:

decreasing the predetermined threshold value when the data amount of the generated space information code is smaller than a predetermined lower limit value;

re-correcting the space information so that the space information at a frequency band having an importance smaller than the decreased threshold value is equalized in the adjacent frequency band direction;

re-generating the space information code based on the re-corrected space information; and generating the encoded audio signal by multiplexing the low channel audio code and the re-generated space information code.

5. The audio encoding device according to claim 1, wherein the processor further executes:

extracting similarity and intensity difference between the frequency signals of the channels as the space information;

smoothing at least one of the similarity and the intensity difference at a frequency band having an importance smaller than the threshold value in the adjacent frequency band direction; and generating the space information code by encoding a difference of similarity and a difference of intensity difference obtained by calculating difference of values of the corrected similarity and intensity difference in the frequency direction.

6. The audio encoding device according to claim 5, wherein the processor further executes:

storing a similarity code amount that is a code data amount of a difference of similarity calculated for a first frame, and an intensity difference code amount that is a code data amount of a difference of intensity difference;

setting a similarity weight that is a weighting coefficient for the similarity to a value greater than a value of an intensity difference weight that is a weighting coefficient for intensity difference when the similarity code amount is greater than the intensity difference code amount, and setting the similarity weight to a value smaller than a value of the intensity difference weight when the similarity code amount is smaller than the intensity difference code amount; and determining importance of a second frame that is behind the first frame so that contribution of the similarity calculated in the second frame to the importance increases as the similarity weight increases and contribution of the intensity difference calculated in the second frame to the importance increases as the intensity difference weight increases.

7. An audio encoding method, comprising:

transforming signals of channels included in an audio signal having a first number of channels into frequency signals respectively by time-frequency transforming the signals of the channels frame by frame, each frame having a predetermined time length;

generating an audio frequency signal having a second number of channels which is smaller than the first number of channels by down-mixing the frequency signals of the channels;

generating a low channel audio code by encoding the audio frequency signal;

extracting space information representing spatial information of a sound from the frequency signals of the channels;

calculating an importance representing a degree how much the space information affects human hearing for each frequency based on the space information;

correcting the space information so that the space information at a frequency band having importance smaller than a predetermined threshold value is equalized to an adjacent frequency band direction;

generating a space information code by encoding a difference of space information obtained by calculating a difference of values of the corrected space information in the adjacent frequency band direction; and generating an encoded audio signal by multiplexing the low channel audio code and the space information code.

8. A non-transitory computer-readable recording medium storing a program for causing a computer to execute a moving image encoding process, the process comprising:

transforming signals of channels included in an audio signal having a first number of channels into frequency signals respectively by time-frequency transforming the signals of the channels frame by frame, each frame having a predetermined time length;

generating an audio frequency signal having a second number of channels which is smaller than the first number of channels by down-mixing the frequency signals of the channels;

generating a low channel audio code by encoding the audio frequency signal;

extracting space information representing spatial information of a sound from the frequency signals of the channels;

calculating an importance representing a degree how much the space information affects human hearing for each frequency based on the space information;

correcting the space information so that the space information at a frequency band having importance smaller than a predetermined threshold value is equalized to an adjacent frequency band direction;

generating a space information code by encoding a difference of space information obtained by calculating a difference of values of the corrected space information in the adjacent frequency band direction; and generating an encoded audio signal by multiplexing the low channel audio code and the space information code.

9. A video transmission device, comprising:

a processor; and a memory that stores a plurality of instructions, which when executed by the processor causes the processor to execute;

encoding an inputted moving image signal;

encoding an inputted audio signal having a first number of channels;

transforming signals of channels included in the audio signal into frequency signals respectively by time-frequency transforming the signals of the channels frame by frame, the frame having a predetermined time length;

generating an audio frequency signal having a second number of channels which is smaller than the first number of channels by down-mixing the frequency signals of the channels;

generating a low channel audio code by encoding the audio frequency signal;

extracting space information representing spatial information of a sound from the frequency signals of the channels;

calculating an importance representing a degree how much the space information affects human hearing for each frequency based on the space information;

correcting the space information so that the space information at a frequency band having importance smaller than a predetermined threshold value is equalized to an adjacent frequency band direction;

generating a space information code by encoding a difference of space information obtained by calculating a difference of values of the corrected space information in the adjacent frequency band direction;

generating an encoded audio signal by multiplexing the low channel audio code and the space information code; and generating a video stream by multiplexing an encoded moving image signal and an encoded audio signal.

10. The audio encoding device according to claim 1, wherein the space information includes similarity information between the frequency signals prior to the down-mixing that represents a spread of sound and intensity difference information between the frequency signals prior to the down-mixing that represents a localization of sound.

* * * * *

UNITED STATES PATENT AND TRADEMARK OFFICE

CERTIFICATE OF CORRECTION

PATENT NO. : 8,818,539 B2
APPLICATION NO. : 12/829650
DATED : August 26, 2014
INVENTOR(S) : Masanao Suzuki et al.

It is certified that error appears in the above-identified patent and that said Letters Patent is hereby corrected as shown below:

In the claims

Column 18, line 35, in claim 1, delete “execute;” and insert -- execute: --, therefor.
Column 20, line 60, in claim 9, delete “execute;” and insert -- execute: --, therefor.

Signed and Sealed this
Eighteenth Day of November, 2014

Michelle K. Lee

Michelle K. Lee
*Deputy Director of the United States Patent and Trademark Office*